US005927611A

United States Patent [19]

Palestrant

[11] Patent Number: 5,927,611

[45] Date of Patent: Jul. 27, 1999

[54] ENHANCED PERFORMANCE ATOMIZING NOZZLE

[76] Inventor: Nathan Palestrant, 5120 N. 79th Pl., Scottsdale, Ariz. 85250

[21] Appl. No.: 09/054,665

[22] Filed: Apr. 3, 1998

[51] Int. Cl.[6] ..... B05B 1/34; B05B 3/04

[52] U.S. Cl. ..... 239/380; 239/381; 239/382; 239/383; 239/483; 239/482; 239/589

[58] Field of Search ..... 239/380, 381, 239/382, 383, 461, 482, 483, 589, 590

[56] References Cited

U.S. PATENT DOCUMENTS

| | | | |
|---|---|---|---|
| 932,718 | 8/1909 | Rachmann | 239/383 |
| 2,559,592 | 7/1951 | Button et al. | 239/590 |
| 4,721,250 | 1/1988 | Kennedy et al. | 239/383 |
| 5,143,293 | 9/1992 | Pairis | 239/383 X |
| 5,154,356 | 10/1992 | Sorenson | 239/550 |
| 5,433,383 | 7/1995 | Sundholm | 239/383 |
| 5,810,259 | 9/1998 | Sinclair | 239/383 |

*Primary Examiner*—Andres Kashnikow
*Assistant Examiner*—Robin O. Evans
*Attorney, Agent, or Firm*—Meschkow & Gresham, P.L.C.; Jordan M. Meschkow; Lowell W. Gresham

[57] ABSTRACT

An atomizing nozzle (40) includes a body (44) having an fluid inlet end (50), a fluid outlet end (52), and a channel (54) located between the inlet end (50) and the outlet end (52). A free floating plunger (46) resides in the channel (54). The plunger (46) has a frusto-conical portion (64) facing the inlet end (50) and a cylindrical portion (62) facing the outlet end (52). The frusto-conical portion (64) causes the plunger (46) to resist getting wedged in the channel (54) so that a mist (102) having fluid particles of uniform size is ejected from the outlet end (50).

15 Claims, 3 Drawing Sheets

ENHANCED PERFORMANCE ATOMIZING NOZZLE

TECHNICAL FIELD OF THE INVENTION

The present invention relates generally to mist heads which atomize pressurized fluid. Specifically, the present invention relates to atomizing nozzles that are configured to consistently produce a uniform fine mist.

BACKGROUND OF THE INVENTION

Atomizing nozzles, also called mist heads, are used in connection with misting systems to produce fog or at least a fine mist. Typically, water under pressure is forced through the atomizing nozzles to produce the mist. Desirably, the mist is sufficiently fine so that it rapidly evaporates. As the mist evaporates, the general area around the atomizing nozzles becomes cooler. Rapid evaporation prevents people and property located in the mist from getting wet and enhances the cooling effect. Accordingly, misting systems are often used for cooling and for increasing humidity.

In order to produce a fog or at least a fine mist that quickly evaporates, atomizing nozzles include a small orifice through which a fluid, such as water, under high pressure passes as it exits the nozzle. In addition, a plunger, also called a poppet or impeller, is positioned within a passage that connects to the orifice. The action of the plunger within the passage helps break the fluid into a fog or fine mist.

FIG. 1 shows a cross sectional side view of a prior art atomizing nozzle 20. Nozzle 20 has a conventional cylindrically shaped plunger 22 residing in a passage 24 of nozzle 20. Passage 24 has an inlet end 26 for receiving the fluid to be atomized, and an outlet end 28 for ejecting the atomized fluid. Conventionally, following installation of cylindrical plunger 22 into passage 24, an orifice-bearing plug 30 is press-fit into passage 24 from outlet end 28 of prior art nozzle 20. Orifice-bearing plug 30 prevents cylindrical plunger 22 from escaping from passage 24 through outlet end 28. A retaining element (not shown) may also be implemented to prevent cylindrical plunger 22 from escaping from inlet end 26.

FIG. 2 shows a cross sectional side view of the position of cylindrical plunger 22 in prior art atomizing nozzle 20 when impacted by a pressurized fluid 32. As pressurized fluid 32 flows into inlet end 26 of atomizing nozzle 20, it impacts cylindrical plunger 22 driving it toward outlet end 28. Fluid 32 flows around cylindrical plunger 22 through spaces 34 between plunger 22 and the walls of passage 24. Due to the cylindrical shape of plunger 22, as fluid 32 drives plunger 22 toward outlet end 28, plunger 22 can get wedged in passage 24 such that an axial dimension of plunger 22 is not parallel with the axial dimension of passage 24.

This wedged position of cylindrical plunger 22 is highly undesirable because fluid 32 does not flow through spaces 34 around cylindrical plunger in a uniform flow pattern. This non-uniform flow pattern produces an unsatisfactory mist 36 that is subsequently ejected from outlet end 28. Mist 36 is unsatisfactory because mist 36 includes fluid particles having a wide range of diameters. As a result, a substantial proportion of the fluid particles are not effectively evaporated and the larger fluid particles cause the general area around prior art nozzle 20 to become wet.

In addition, the wedged position of cylindrical plunger 22 prevents plunger 22 from rotating or spinning within passage 24. Thus, a problem is created because residual mineral materials contained in fluid 30 will be deposited on the immobile and wedged cylindrical plunger 22 after prolonged use. These deposited materials can partially block passage 24 so that fluid particles in mist 36 become much larger and are much less effectively evaporated.

Typically, orifice-bearing plug 30 is pressed into place in outlet end 28 with great force so that a fluid tight seal results even when fluid 30 is placed under great pressure. Since retaining ring 30 is press-fit with such great force, it cannot thereafter be removed for subsequent cleaning of passage 24 to remove the deposited mineral materials.

In time, these deposited mineral materials will eventually completely block passage 24 so that prior art nozzle 20 is no longer able to eject mist 36. Accordingly, conventional atomizing nozzles are expensive to acquire and become clogged before long due, in part, by the immobile and wedged position of the conventional cylindrical plunger. The blocked nozzles must then be thrown away because they cannot be unclogged and replacement nozzles must be purchased and installed.

SUMMARY OF THE INVENTION

Accordingly, it is an advantage of the present invention that an enhanced performance atomizing nozzle for producing a mist having a uniform fluid particle size is provided.

Another advantage of the present invention is that an atomizing nozzle plunger is provided that remains free floating in the nozzle for best atomization of fluid.

Another advantage of the present invention is that an atomizing nozzle plunger is provided that resists the rapid build-up of residual mineral materials contained in the fluid.

Another advantage of the present invention is than an atomizing nozzle plunger is provided that is inexpensive to manufacture and lengthens the life cycle of the atomizing nozzle.

The above and other advantages of the present invention are carried out in one form by an enhanced performance atomizing nozzle comprising a body and a free floating plunger. The body has an inlet end, an outlet end, and a channel located between the inlet end and the outlet end. The free floating plunger resides in the channel. The plunger has a frusto-conical portion facing the inlet end and a cylindrical portion facing the outlet end.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
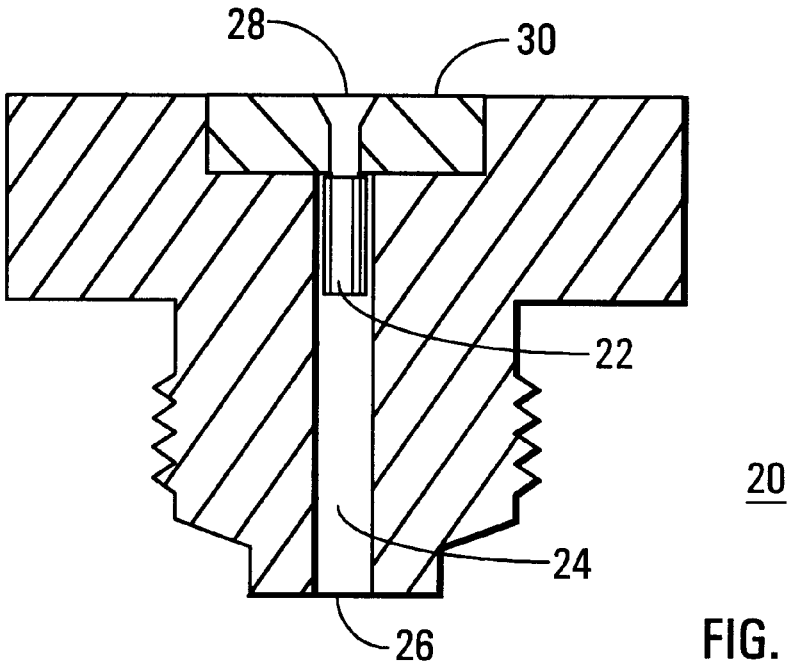
FIG. 1 PRIOR ART
FIG. 1 shows a cross sectional side view of a prior art atomizing nozzle.
Figure 2:
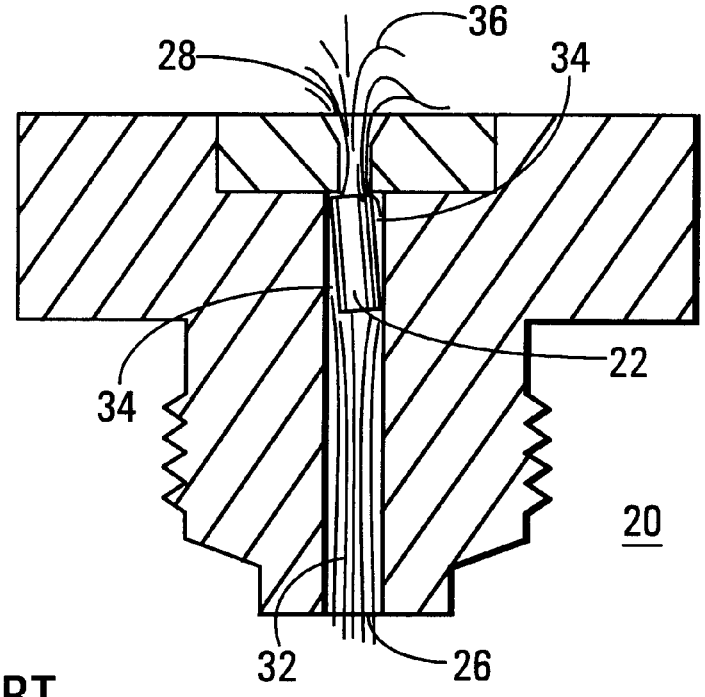
FIG. 2 PRIOR ART
FIG. 2 shows a cross sectional side view of the position of a cylindrical plunger in the prior art atomizing nozzle when impacted by a pressurized fluid.
Figure 3:
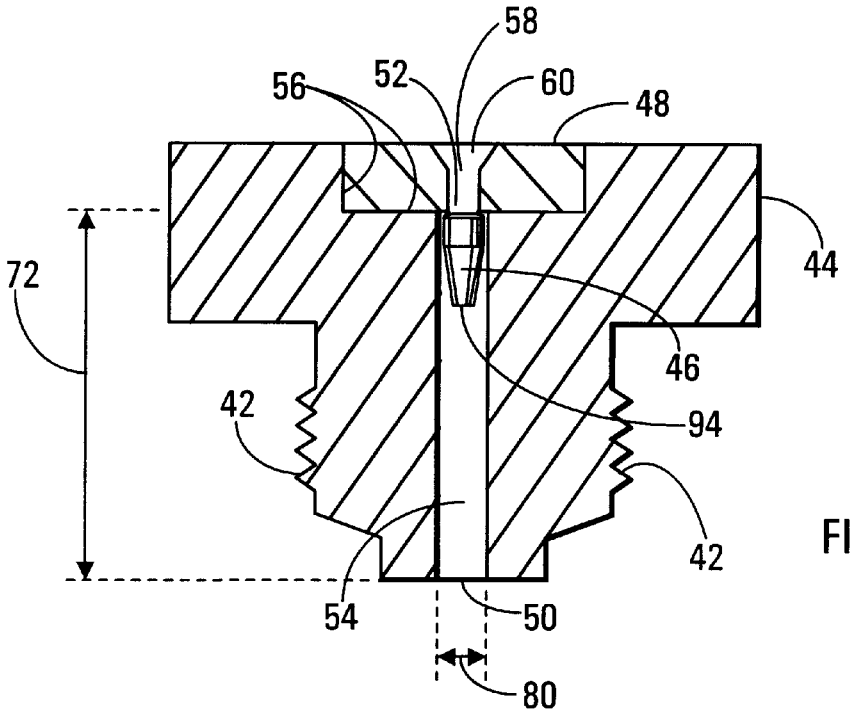
FIG. 3 shows a cross sectional side view of an atomizing nozzle configured in accordance with the present invention.

FIG. 3 shows a cross sectional side view of an atomizing nozzle 40 configured in accordance with the present invention. Atomizing nozzle 40 has threads 42 that are configured to couple to corresponding threads on a pipe (not shown) of a misting system (not shown). Atomizing nozzle 40 is shown with threads 42, however, any conventional leak resistant coupling is acceptable. Moreover, the type of coupling is not crucial to the understanding of the present invention and variations in the coupling will not be described in detail herein.

In the preferred embodiment, atomizing nozzle includes a body 44, a free floating plunger 46, and an orifice-bearing plug 48. Body 44 has an inlet end 50, an outlet end 52, and a cylindrical first channel 54 located between inlet end 50 and outlet end 52. The fluid flowing through atomizing nozzle 40 enters inlet end 50 and is ejected from outlet end 52. Free floating plunger 46 resides in first channel 54. Orifice-bearing plug 48 is press-fit into a recessed portion 56 of body 44 located at outlet end 52 and retains free floating plunger 46 in first channel 54.

Orifice-bearing plug 48 has a second channel 58 for allowing a passage of atomized fluid, or mist, from outlet end 52 of body 44 through a small exit orifice 60 of plug 48 into the air. Those skilled in the art will recognize that atomizing nozzle 40 need not include plug 48, and body 44 need not include the corresponding recessed portion 56, for retaining free floating plunger 46. Rather, outlet end 52 may include a small exit orifice (not shown) that has a diameter that is small enough to prevent free floating plunger 46 from being ejected through outlet end 52. In addition, a retaining element (not shown) may also be implemented to prevent free floating plunger 46 from escaping from inlet end 26. Various mechanisms used to prevent plunger 46 from escaping from first channel 54 are known to those skilled in the art and will not be described in detail herein.

Figure 4:
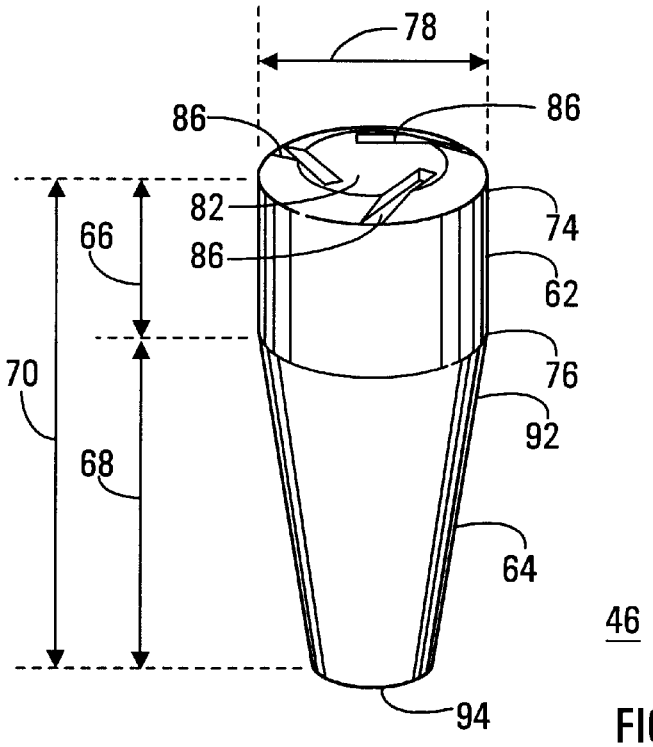
FIG. 4 shows a perspective view of the free floating plunger in accordance with the present invention.

FIG. 4 shows a perspective view of free floating plunger 46 in accordance with the present invention. Free floating plunger 46 includes a cylindrical portion 62 and a frusto-conical portion 64. Frusto-conical portion 64 faces inlet end 50 (FIG. 3) and cylindrical portion 62 faces outlet end 52 (FIG. 3). Free floating plunger 46 is desirably manufactured in an inexpensive batch process from a readily machined, rigid material such as a single piece of stainless steel, an aluminum alloy, a titanium alloy, and so forth.

Cylindrical portion 62 is a solid cylinder having a first axial length 66. Frusto-conical portion 64 is a solid frustum having a second axial length 68 which is greater than first axial length 66. A combined length of first and second axial lengths 66 and 68, respectively, produces an axial length 70 of free floating plunger 46. In addition, first channel 54 has an axial length 72 (FIG. 3) from inlet end 50 to outlet end 52. Desirably, channel axial length 72 is greater than plunger axial length 70.

Cylindrical portion 62 has a first end 74 and a second end 76. First and second ends 74 and 76 are oriented perpendicular to the axis of cylindrical portion 62 and first and second ends 74 and 76 have an cylinder diameter 78. In addition, first channel 54 has an inner diameter 80 (FIG. 3). Desirably, cylinder diameter 78 is smaller than inner diameter 80 of first channel 54 (FIG. 3). Thus, both plunger axial length 70 and plunger cylinder diameter 78 allow free floating plunger to move as required in first channel 54 to achieve adequate atomization.

First end 74 includes a raised planar surface 82 located at a central portion of first end 74. The height difference between the outer edge of first end 74 and raised planar surface 82 is achieved by manufacturing a gradual slope between the outer edge and raised planar surface 82. This slope is produced by conventional manufacturing techniques which are not described in detail herein.

Figure 5:
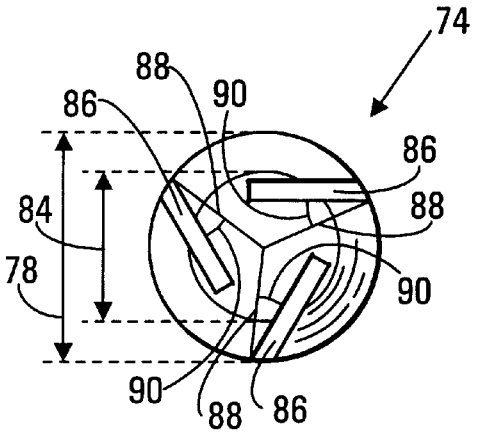
FIG. 5 shows a top view of a first end of a cylindrical portion of the free floating plunger in accordance with the present invention.

FIG. 5 shows a top view of first end 74 and raised planar surface 82 of cylindrical portion 62 in accordance with the present invention. Raised planar surface 82 has a diameter 84 which is smaller than cylinder diameter 78 of first end 74. First end 74 also includes a plurality of grooves 86 extending from an outer edge 88 of first end 74 and directed inward on the surface of first end 74. In the preferred embodiment, first end 74 has three of grooves 86. Grooves 86 tilt away from a radius 88 of first end 74 and penetrate raised planar surface 82. An angle 90 describes the degree of tilt away from radius 88 for each of grooves 86. The function of grooves 86 in combination with raised planar surface 82 will be described in detail below.

Figure 6:
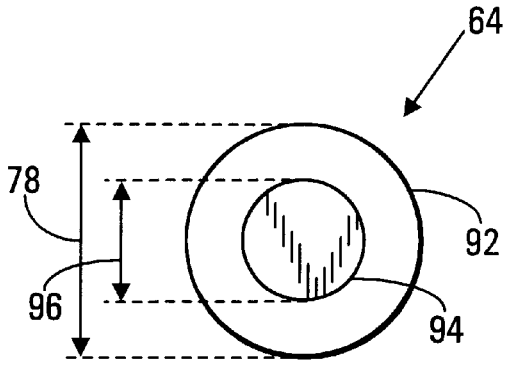
FIG. 6 shows a bottom view of a frusto-conical portion of the free floating plunger in accordance with the present invention.

FIG. 6 shows a bottom view of frusto-conical portion 64 of free floating plunger 46 in accordance with the present invention. Frusto-conical portion 64 has a third end 92 and a fourth end 94. Third and fourth ends 92 and 94 are oriented perpendicular to the axis of frusto-conical portion 64. Third end 92 is characterized by cylinder diameter 78. In other words, third end 92 has an outer diameter that is substantially equal to cylinder diameter 78 of cylindrical portion 62. In addition, fourth end 94 has an outer diameter 96 which is smaller than cylinder diameter 78 of third end 92.

Referring momentarily to FIG. 3, cylindrical portion 62 and frusto-conical portion 64 of free floating plunger 46 are axially aligned along an axial dimension of channel 54. Third end 92 of frusto-conical portion 64 is coupled to second end 76 of cylindrical portion 62 and cylindrical portion 62 faces outlet end 52. Thus, the smallest surface of free floating plunger 46, i.e. fourth end 94, faces inlet end 50 of body 44.

Figure 7:
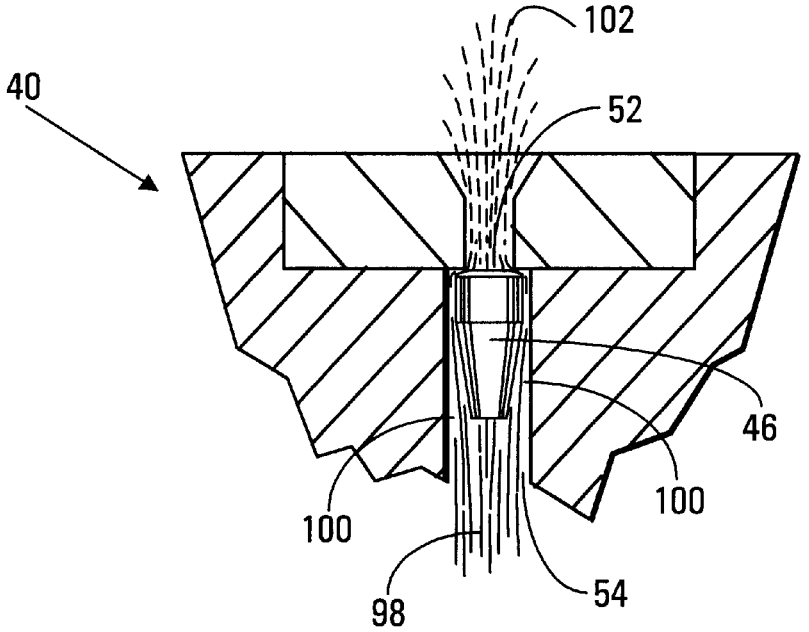
FIG. 7 shows a cross sectional side view of the position of a free floating plunger in a portion of the atomizing nozzle when impacted by a pressurized fluid in accordance with the present invention.

FIG. 7 shows a cross sectional side view of the position of free floating plunger 46 in a portion of atomizing nozzle 40 when impacted by a pressurized fluid 98, such as water, in accordance with the present invention. In operation, as water 98 flows through inlet end 50 (FIG. 3) and into channel 54, water 98 impacts free floating plunger 46 and drives plunger 46 toward outlet orifice 52.

The shape of frusto-conical portion 64 causes water 98 to flow uniformly around frusto-conical portion 64 and into gaps 100 between portion 64 and the walls of channel 54. In addition, the greater axial length 68 (FIG. 4) of frusto-conical portion 64 relative to length 66 (FIG. 4) of cylindrical portion 62 serves to stabilize plunger 46 so that the longitudinal axis of plunger 46 stays substantially aligned with the longitudinal axis of channel 54. Thus, frusto-conical portion 64 substantially prevents free floating plunger 46 from becoming wedged in channel 54 when impacted by water 98.

As water 98 flows past free floating plunger 46, plunger 46 rotates by the action of water 98 flowing over raised planar surface 82 (FIG. 5) and through grooves 86 formed in first end 74 (FIG. 5). The rotation of free floating plunger 46 produces turbulence as water 98 flows through grooves 86 and out of outlet end 52. This turbulence is a factor in generating a fine mist 102 having uniform small fluid particles that readily evaporate to cool or humidify the air near nozzle 40 without wetting the general area around nozzle 40.

In addition, the rotation of free floating plunger 46 combined with the non-wedged position of plunger 46 helps to prevent or remove mineral deposits which might build up on plunger 46, in channel 54, and in outlet end 54. By substantially preventing the build-up of mineral deposits in nozzle 40, the life cycle of the atomizing nozzle is lengthened.

In summary, the present invention provides an enhanced performance atomizing nozzle for producing a mist having a uniform fluid particle size. A readily manufactured atomizing nozzle plunger is provided with a conically shaped end that causes the water to uniformly flow around the plunger to cause the plunger to remain free floating in the nozzle. In addition, the plunger includes grooves that cause the plunger to rotate as water flows through them producing turbulence for best atomization of fluid. The uniform flow of the water and the rotation of the plunger cause the nozzle to resist the rapid build-up of residual mineral materials thus lengthening the life cycle of the atomizing nozzle.

Although the preferred embodiments of the invention have been illustrated and described in detail, it will be readily apparent to those skilled in the art that various modifications may be made therein without departing from the spirit of the invention or from the scope of the appended claims. For example, free floating plunger may be sized and retrofit into pre-existing atomizing nozzles. In addition, the grooves in the cylindrical portion of the plunger may be altered in size or shape yet produce the similar rotational characteristics of the free floating plunger of the present invention.

What is claimed is:

1. An atomizing nozzle comprising:

a body having an inlet end, outlet end, and a channel located between said inlet end and said outlet end; and a free floating plunger residing in said channel, said plunger having a frusto-conical portion facing said inlet end and a cylindrical portion facing said outlet end, wherein said cylindrical portion has a first end and a second end oriented perpendicular to an axial dimension of said cylindrical portion, with said first end directed toward said outlet end of said body and including a raised planar surface located at a central portion of said first end, said raised planar surface having a diameter smaller than an outer diameter of said first end, and wherein said frusto-conical portion has a third end and a fourth end oriented perpendicular to an axial dimension of said frusto-conical portion, said third end of said frusto-conical portion being coupled to said second end of said cylindrical portion.

2. An atomizing nozzle as claimed in claim 1 wherein said channel is a first channel, and said nozzle further comprises an orifice bearing plug coupled to said outlet end for retaining said plunger in said first channel, said orifice bearing plug having a second channel for allowing a passage of mist from said outlet end into the air.

3. An atomizing nozzle as claimed in claim 1 wherein:

said channel is a cylindrical channel having an inner diameter; and said cylindrical channel has an outer diameter at said outlet end, said outer diameter being smaller than said inner diameter for retaining said plunger in said first channel.

4. An atomizing nozzle as claimed in claim 1 wherein said cylindrical portion and said frusto-conical portion of said plunger are axially aligned along an axial dimension of said first channel.

5. An atomizing nozzle as claimed in claim 1 wherein:

said free-floating plunger has an axial length; and said first channel has an axial length, said channel axial length being greater than said plunger axial length.

6. An atomizing nozzle as claimed in claim 1 wherein:

said first and second ends have a first outer diameter; and said third end has a second outer diameter, said second outer diameter being substantially equal to said first outer diameter.

7. An atomizing nozzle as claimed in claim 6 wherein said fourth end has a third outer diameter, said third outer diameter being smaller than said second outer diameter.

8. An atomizing nozzel as claimed in claim 1 wherein:

said first end of said cylindrical portion includes a plurality of grooves extending from an outer edge of said first end and directed inward on a surface of said first end.

9. An atomizing nozzle as claimed in claim 8 wherein:

said surface of said first end has a radius; and an angle describes a degree of tilt away from said radius for each of said grooves, said angle being configured to cause said free-floating plunger to rotate in response to fluid in communication with said grooves.

10. An atomizing nozzle as claimed in claim 8 wherein said first end includes at least three of said grooves.

11. An atomizing nozzle as claimed in claim 1 wherein:

said cylindrical portion has a first axial length; and said frusto-conical portion has a second axial length, said second axial length being greater than said first axial length.

12. An atomizing nozzle as claimed in claim 1 wherein said first end of said cylindrical portion includes a plurality of grooves extending from an outer edge of said first end and penetrating said raised planar surface.

13. A free floating plunger in a body of an atomizing nozzle, said body having an inlet end, an outlet end, and a channel located between said inlet end and said outlet end, and said free floating plunger comprising:

a cylindrical portion facing said outlet end, said cylindrical portion having a first end and a second end oriented perpendicular to an axial dimension of said cylindrical portion, wherein said first end is directed toward said outlet end of said body and includes a raised planar surface located at a central portion of said first end, said raised planar surface having a diameter smaller than an outer diameter of said first end; and a frusto-conical portion facing said inlet end, said frusto-conical portion having a third end and a fourth end, said third and fourth ends being oriented perpendicular to an axial dimension of said frusto-conical portion, said third end of said frusto-conical portion being coupled to said second end of said cylindrical portion, a diameter of said fourth end being smaller than a diameter of said third end, and said free floating plunger is configured to reside in said channel of said body.

14. A free floating plunger as claimed in claim 13 wherein:

said first end of said cylindrical portion further includes a plurality of grooves extending from an outer edge of said first end and penetrating said raised planar surface, said grooves being tilted away from a radius of said surface of said first end, and an angle describes a degree of tilt away from said radius for each of said grooves.

15. A free floating plunger as claimed in claim 13 wherein:

said cylindrical portion has a first axial length; and said frusto-conical portion has a second axial length, said second axial length being greater than said first axial length.

* * * * *